US008438785B2

(12) United States Patent
McDonough

(10) Patent No.: US 8,438,785 B2
(45) Date of Patent: May 14, 2013

(54) SECURABLE PARAPET CAP ROOF MAT

(76) Inventor: Steven D. McDonough, Pleasant Prairie, WI (US)

( * ) Notice: Subject to any disclaimer, the term of this patent is extended or adjusted under 35 U.S.C. 154(b) by 297 days.

(21) Appl. No.: 12/772,575

(22) Filed: May 3, 2010

(65) Prior Publication Data

US 2010/0205878 A1 Aug. 19, 2010

Related U.S. Application Data

(63) Continuation-in-part of application No. 12/140,077, filed on Jun. 16, 2008, now abandoned.

(51) Int. Cl.
*E04D 15/00* (2006.01)
*E04B 1/92* (2006.01)

(52) U.S. Cl.
USPC ..... 52/3; 428/99; 428/100; 150/154

(58) Field of Classification Search ..... 428/100, 428/99; 150/154, 158, 165, 166; 52/3, 4
See application file for complete search history.

(56) References Cited

U.S. PATENT DOCUMENTS

| | | | | |
|---|---|---|---|---|
| 1,702,635 | A | 2/1929 | Hasalone | |
| 4,137,356 | A | 1/1979 | Shoemaker et al. | |
| 4,167,599 | A | 9/1979 | Nissinen | |
| 4,674,245 | A | 6/1987 | Turner | |
| 5,157,804 | A | 10/1992 | Williams | |
| 5,452,973 | A | 9/1995 | Arvin | |
| 5,916,031 | A | 6/1999 | Casillan | |
| 5,935,676 | A | 8/1999 | Merriman et al. | |
| 6,003,929 | A | 12/1999 | Birdsell | |
| 6,138,798 | A | 10/2000 | Macuga | |
| 6,292,957 | B1 | 9/2001 | Thompson | |
| 6,353,943 | B1 | 3/2002 | Stevens | |
| 6,419,433 | B1 * | 7/2002 | Chou | 410/97 |
| 6,896,533 | B2 | 5/2005 | Schubert et al. | |
| 7,008,154 | B1 | 3/2006 | Nolle | |

* cited by examiner

*Primary Examiner* — Alexander Thomas
(74) *Attorney, Agent, or Firm* — Jansson Munger McKinley & Shape Ltd.

(57) ABSTRACT

In a first embodiment a safety mat for use with a parapet cap on a wall is disclosed. The cap extends over the top of the wall and partially down each side of the wall. The safety mat includes a durable flexible pad having a width greater than a width of the top wall; a first cinch down strap extending at a first end thereof from an interior of the pad toward a first width end; and a second cinch down strap extending at a first end thereof from the interior of the pad toward a second width end.

21 Claims, 3 Drawing Sheets

SECURABLE PARAPET CAP ROOF MAT

RELATED APPLICATION

This application claims priority to U.S. patent application Ser. No. 12/140,077, filed on Jun. 16, 2008, now abandoned the contents of which are incorporated by reference herein.

FIELD OF THE INVENTION

The invention relates generally to the field of safety equipment and more particularly to a safety mat for use with a parapet wall or a roof having a low level wall with a protective cap around the perimeter.

BACKGROUND OF THE INVENTION

Many flat building roofs have parapet walls or walls that project above the perimeter around the edges of the roof. The parapet wall in turn usually has a cap over the top of the wall and extending partially down each side of the wall for sealing the top of the wall. This cap is made of a variety of materials including sheet metal. In many cases, in order to access the roof a ladder must be raised to the side of the parapet wall and the person trying to access the roof will have to step onto and over the wall from the ladder. Such a maneuver can be dangerous under the best conditions and especially so if the cap is wet from dew, rain snow, sleet or ice.

The concept of utilizing a mat over a surface to increase traction is well known. Various designs of mats for use in roofing settings have been put forth. U.S. Pat. No. 5,935,676 to Merriman et al. discloses a slip resistant floor mat for use on angled roofs. The mat includes a layered anti-slip surface with cloth reinforcing strip. The mat is held in place by hooks attached to the mat at one end.

Another example is seen in U.S. Pat. No. 4,674,245 to Turner in which a portable roof mat is disclosed. This mat is designed to be utilized on roof surfaces to create a walkway on a roof.

Other safety mat designs have incorporated features pertaining to how the anti-slip surface is to be designed. For example, U.S. Pat. No. 4,137,356 to Shoemaker et al. discloses a specific pattern of raised projections for supplying traction.

SUMMARY OF THE INVENTION

In a first embodiment a safety mat for use with a parapet cap on a wall is disclosed. The cap extends over the top of the wall and partially down each side of the wall. The safety mat includes a flexible and durable pad having a width greater than a width of the top wall; a first cinch down strap extending at a first end thereof from an interior of the pad toward a first width end; and a second cinch down strap extending at a first end thereof from the interior of the pad toward a second width end.

In another preferred embodiment of the mat the first and second cinch down straps include hooks on an end opposite the interior of the pad. It is highly preferred that the safety mat further include a third cinch down strap extending at a first end thereof from the interior of the pad toward a first width end; a fourth cinch down strap extending at a first end thereof from the interior of the pad toward a second width end and a fifth cinch down strap extending between the third and fourth cinch down straps from the interior of the pad toward the second width end.

In yet another preferred embodiment, the safety mat includes a retainer for holding the safety mat in a rolled, folded or otherwise compact state. In further embodiments the width of the safety mat is dimensioned so that the flexible pad hangs over the parapet cap extending partially down the wall when the safety mat is in the deployed position.

In preferred versions, the flexible pad of the safety mat further includes a length and an open pattern section extending the entire length of the pad and a part of the width of the pad. It is highly preferable that the open pattern section is at least as wide as the section of the parapet cap covering the top of the wall.

In another embodiment, the safety mat further includes a pair of ladder cinch down straps extending at a first end thereof from the interior of the pad toward a first width end. Such an embodiment could also include a pair of ladder mounting straps for holding the safety mat onto a top of a ladder while the ladder is lifted.

In a still further embodiment a method of protecting a parapet cap disposed over the top of a wall and extending at least partially down each side of the wall is disclosed. The method includes the step of providing a safety mat including a flexible pad having a width greater than a width of the top wall; a first cinch down strap extending at a first end thereof from an interior of the pad toward a first width end; and a second cinch down strap extending at a first end thereof from the interior of the pad toward a second width end. Next, the safety mat is placed over the top of the wall so that first and second cinch down straps hang over different sides of the parapet cap. Finally, each of the first and second cinch down straps are secured to a respective end of the parapet cap extending down the wall.

In other embodiments of the method the safety mat further includes a third cinch down strap extending at a first end thereof from the interior of the pad toward a first width end; a fourth cinch down strap extending at a first end thereof from the interior of the pad toward a second width end and a fifth cinch down strap extending between the third and fourth cinch down straps from the interior of the pad toward the second width end. In such an embodiment the method further includes the step of securing each of the third, fourth and fifth cinch down straps to a respective end of the parapet cap extending down the wall. Furthermore, the method may include cinch down straps with hooks on an end opposite the interior of the pad.

In other preferred embodiments the method includes a retainer for holding the safety mat in a compact state when not deployed. In another preferred embodiment, the width of the flexible pad used in the method is dimensioned so that the flexible pad hangs over the parapet cap extending partially down the wall when the safety mat is in the deployed position. In a preferred method, the flexible pad further includes a length and an open pattern section extending the entire length of the pad and a part of the width of the pad. In a highly preferable version of the method, the width of the open pattern section is at least as wide as the section of the parapet cap covering the top of the wall.

In further embodiments of the method, the safety mat further includes a pair of ladder cinch down straps extending at a first end thereof from the interior of the pad toward a first width end. In such an embodiment, the method further includes the step of placing a ladder against the safety mat and securing the ladder cinch straps to the ladder. In addition, the method may include a safety mat with a pair of ladder mounting straps for holding the safety mat onto a top of a ladder while the ladder is lifted.

BRIEF DESCRIPTION OF THE DRAWINGS

In order that the advantages of the invention will be readily understood, a more detailed description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF PREFERRED EMBODIMENTS

Figure 1:
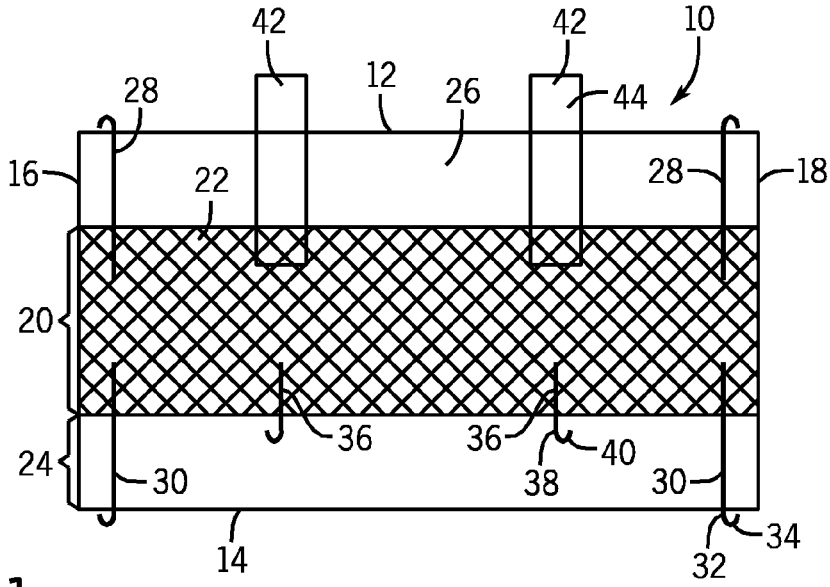
FIG. 1 is a top plan view of a safety mat according to a preferred embodiment.

Referring now to FIG. 1 a safety mat 10 according to a preferred embodiment is shown. In this embodiment the safety mat 10 is preferably made of rubber and is generally rectangular in shape, although other materials and shapes could be utilized. Safety mat 10 includes opposite length sides 12, 14 and a opposite width sides 16, 18. Safety mat 10 is comprised of three primary regions extending between the width sides 16, 18. A center region 20 in one preferred embodiment is of a crossing pattern defining opening 22 for allowing moisture to pass through. In the preferred embodiment illustrated in FIG. 1, on each side of the center region is a solid side region 24. Furthermore, safety mat 10 includes a top side 26 that, in the preferred embodiment, is coated with an anti-slip or non-slip coating. It may be appreciated that such an anti-slip or non-slip surface may be created by mixing an additive or creating an admixture to form the top surface or top side 26 of safety mat 10. Such additive or admixture may include but are not limited to sand, sandpaper or other textured admixture or surface for grip. Such additives, admixtures and surfaces may be formed from or include one or more of alkyd, urethane, acrylic, epoxy, hybrid, latex, emulsion, hammertone, metallic, electrostatic, dip, aerosol, silicone & PTFE coatings in waterborne, high solids and similar compounds or coatings. In addition, such compounds or coatings may include non-stick coatings, liquid coatings, powder coatings, combination coatings, and the like. The bottom side of safety mat 10 in the embodiment of FIG. 1 (not shown) is typically not coated or included with a non-slip or anti-slip coating, but such surface may be coated or include a mixture within the surface depending on the application and configuration in which the safety mat 10 is being used.

Safety mat 10 further includes a cap strap system. In the preferred embodiment illustrated in FIG. 1, the cap strap system includes two opposite pairs of cinch down straps 28, 30. First pair of straps 28 extends from the interior of the safety mat near opposite width sides 16, 18 and over the first length side 12. The location near, but not at, the width sides 16, 18 ensures that the straps 28 stays over safety mat 10 during use. The opposite pair of straps 30 extends from the interior of the safety mat near opposite width sides 16, 18 and over the second length side 14. Each strap includes an end 32 hanging over the length sides 12, 14 and each end 32 is attached to a hook 34. In this preferred embodiment cinch down straps 28, 30 are of a releasable cam-buckle design; however any tightening straps known in the art could be utilized. For example only, bungee cords or racheting straps could be used. This holds true for any of the cinch down straps described herein.

Safety mat 10 also includes a ladder strap system. In the preferred embodiment illustrated in FIG. 1, this ladder strap system includes a pair of ladder cinch down straps 36. Ladder cinch down straps 36 extend from the interior of safety mat 10 closer to the length side 14 than length side 12 and preferably a ladders-width apart and centered on the middle of the width of safety mat 10. Ladder cinch down straps 36 do not extend past the length sides 12, 14. Each of the ladder cinch down straps 36 includes an end 38 including a hook 40.

Finally, safety mat 10 may include a ladder mounting system. In the preferred embodiment of FIG. 1, this ladder mounting system includes a pair of ladder lifting straps 42. Ladder lifting straps 42 extend from the interior of safety mat 10 closer to length side 12 than length side 14 and preferably a ladders-width apart and centered on the middle of the width of the mat. A top 44 of one of the ladder lifting straps 42 and the bottom (not shown) of the other ladder lifting straps preferably includes releasable buckle or hook and loop fasteners.

Figure 2:
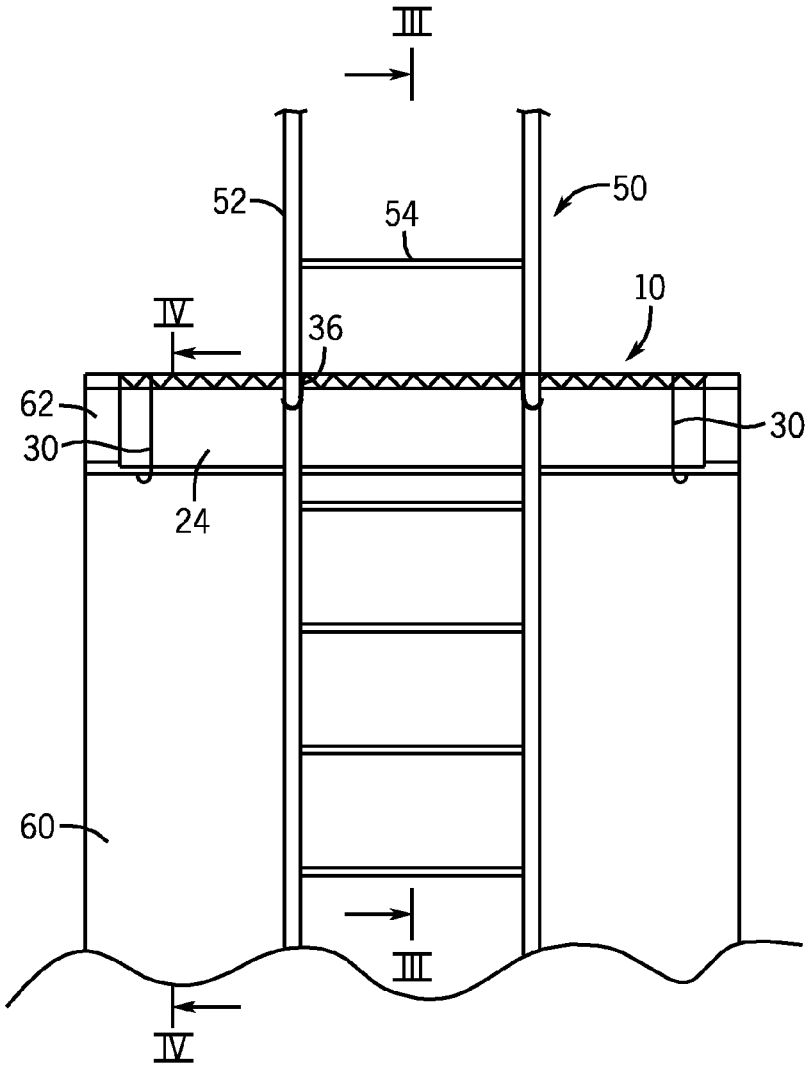
FIG. 2 is a front view of the safety mat of FIG. 1 secured to a parapet cap with a ladder secured to the safety mat.
Figure 3:
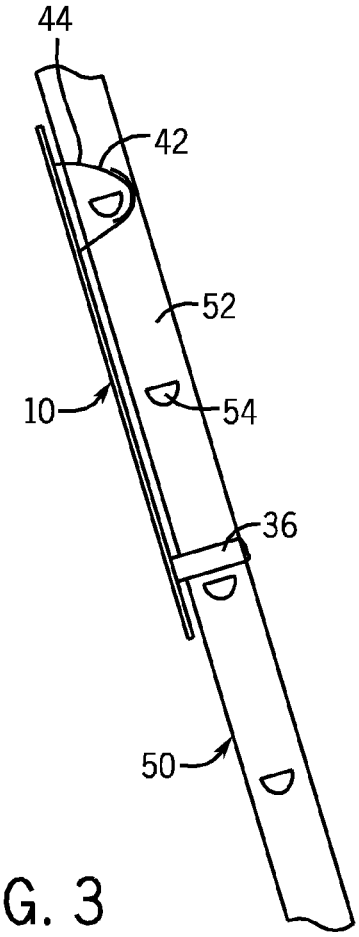
FIG. 3 is a sectional side view of the ladder of FIG. 2 taken along the line III-III of FIG. 2 with a safety mat attached for installation.
Figure 4:
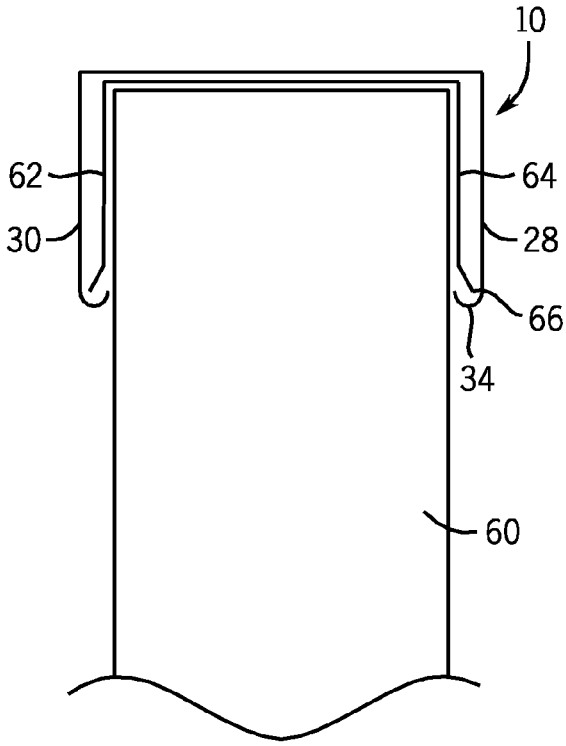
FIG. 4 is a side sectional view taken along the line IV-IV of FIG. 2.

Referring now to FIGS. 2-4 safety mat 10 of the preferred embodiment of FIG. 1 is shown in use. In most cases in order to use safety mat 10, the mat must be raised into position and attached to a cap on top of a parapet wall 60. This is best accomplished by attaching safety mat 10 to a ladder 50 in a preferred embodiment as shown in FIG. 2. Ladder 50 includes side rails 52 and a plurality of steps 54. Ladder cinch down straps 36 are attached to the side rails 52 several steps down from the top of the ladder 50 as seen in FIG. 2. Referring now to FIG. 3, ladder lifting straps 42 are wrapped around a ladder step 54 above where the cinch down straps 36 are placed and secured to each other utilizing releasable buckle or hook and loop fasteners, thus securing safety mat 10 to ladder 50.

Next, ladder 50 is positioned with safety mat 10 in contact with cap 62 of a parapet wall 60. Preferably safety mat 10 is positioned with center region 20 extending slightly over sides 64 of cap 62. This will keep moisture from building up on top of safety mat 10. Once ladder 50 is raised and positioned, the person utilizing safety mat 10 can climb the ladder and undo ladder lifting straps 42 to allow safety mat 10 to overlap the top of cap 62 as seen in FIG. 4.

The final step of the installation is to secure the cap strap system to cap 62. Cinch down straps 28, 30 are put into place with hook 34 over a lower edge 66 of cap 62. Cinch down straps 28, 30 are then tightened and safety mat 10 is secured to cap 62. It is important to note that preferably ladder cinch down straps 36 remain in place in order to keep the ladder in place and positioned close to the building during use.

Figure 5:
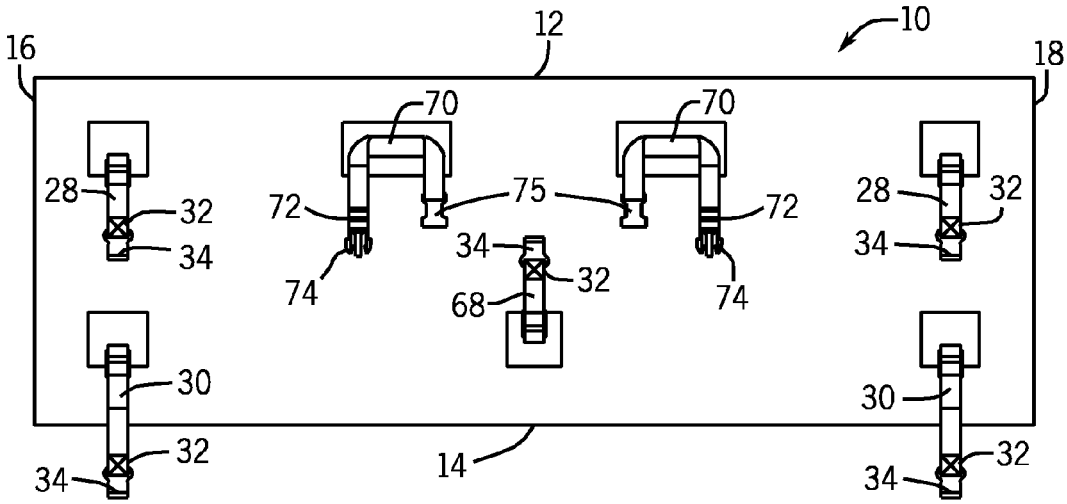
FIG. 5 is a top plan view of a second preferred embodiment of the safety mat.
Figure 6:
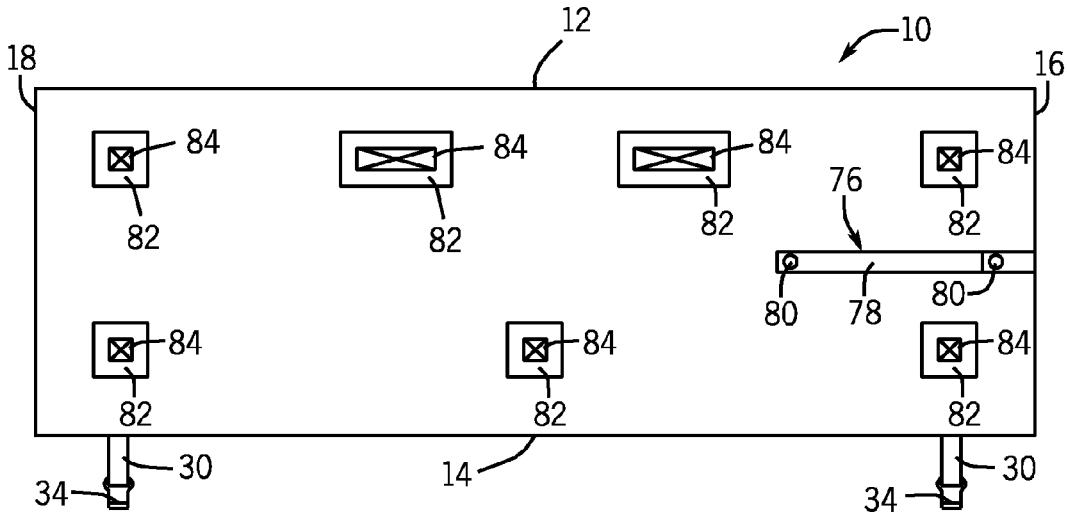
FIG. 6 is bottom plan view of the safety mat of FIG. 5.

Now referring to FIGS. 5 and 6, another preferred embodiment of safety mat 10 is illustrated. Specifically, safety mat 10 is preferably made of rubber and is generally rectangular in shape, although other materials and shapes could be utilized. Safety mat 10 includes opposite length sides 12, 14 and a opposite width sides 16, 18. In the preferred embodiment of FIGS. 5 and 6, safety mat 10 is comprised of one solid piece of rubber which is anti-slip or non-slip flexible material and which does not cause any damage or harm to the parapet cap or the material the cap is made from. It will be appreciated that such anti-slip or non-slip material may be solid or may be of an open woven material as required by the user of the specific application. Safety mat 10 further includes a cap strap system. In the preferred embodiment illustrated in FIGS. 5 and 6, the cap strap system includes two opposite pairs of cinch down straps 28, 30. The first pair of straps 28 extends from the interior of safety mat 10 near opposite width sides 16, 18 and may positioned over the first length side 12. The location near, but not at, the width sides 16, 18 ensures that straps 28 stay over safety mat 10 during use. The opposite pair of straps 30 extends from the interior of safety mat 10 near opposite width sides 16, 18 and over second length side 14. In addition, another positioning and securing strap 68 is positioned between straps 28, 30 for precise and secure placement and holding of safety mat 10 in a specific position when mounted and placed in position for use over the parapet cap or parapet wall. Each strap 28, 30 and 68 includes an end 32 which may be positioned over and hung over the length sides 12, 14. Each end 32 includes an attached hook 34. In the preferred embodiment illustrated in FIGS. 5 and 6, cinch down straps 28, 30 and 68 are of a releasable cam-buckle design; however any tightening straps known in the art could be utilized. For example, bungee cords, racheting straps and straps made of a variety of material could be used. As noted above, any of the cinch down straps described herein may include such adjustment.

Safety mat 10 illustrated in FIGS. 5 and 6 includes another preferred embodiment of a ladder strap system. In the preferred embodiment of FIGS. 5 and 6, the ladder strap system includes a pair of ladder cinch down straps 70. Ladder cinch down straps 70 are affixed to the interior of safety mat 10 closer to the first length side 12 than the second length side 14, and preferably a ladder-width apart and centered on the middle of the width of safety mat 10. Ladder cinch down straps 70 do not extend past the length sides 12, 14. Each ladder cinch down strap 70 includes an end 72 and a releasable buckle arrangement. In one embodiment the releasable buckle arrangement includes a male insert end 74 and a female receiving end 75 for securing safety mat 10 over the parapet cap or wall, and attaching safety mat 10 to the ladder rungs as illustrated in FIGS. 2 and 3.

As also illustrated in FIGS. 5 and 6, a preferred safety mat 10 includes a retaining strap 76 which releasably secures safety mat 10 in a compact position for storage or transport. As illustrated in one preferred embodiment, retaining strap 76 is an elastic band 78 which includes snaps 80 at either end. When safety mat 10 is rolled, elastic ban 78 is positioned around the rolled mat and secured with snaps 80 such that the mat is held in a rolled position for transport, storage or the like. It will be appreciated that any type of securing arrangement can be used to hold safety mat 10 in a rolled or folded condition. Such arrangements may include, but are not limited to, hook and eye fasteners, releasable buckles, hooks, ratchets and the like.

FIG. 6 illustrates the side of safety mat 10 opposite that illustrated in FIG. 5. As is illustrated in FIG. 6, each of the straps 28, 30, 68 and 70 are reinforced on this opposite side of safety mat 10. Such reinforcing may include an additional patch of material such as illustrated by patch 82 or stitching as is illustrated by the "X" stitch 84 associated with each strap 28, 30, 68 and 70. In a highly preferred embodiment, both a reinforcing patch 82 and stitching 84 are used together to provide the most reliable, secure and durable reinforcement for each strap. Other types of reinforcement are also contemplated depending on the application and durability desired. Such may include, but are not limited to, single and multi-layer fabric reinforcement, metallic reinforcement, wire enhanced reinforcement, multi-layer and multi-side reinforcement, combinations thereof and similar materials that will add strength at the connection points of straps 28, 30, 38, 42, 68 and 70, as well as adding strength to safety mat 10 itself. Such material may be layered, adhered sewn into or otherwise positioned within or on safety mat 10 as necessary for a given application. Such material may include cotton, nylon, polyester as well as specialty materials such as Nomex®, Dia-Tuff® or the like, including coated materials for specific applications Reference throughout this specification to "one embodiment," "an embodiment," "a preferred embodiment" or similar language means that a particular feature, structure, or characteristic described in connection with the embodiment is included in at least one embodiment of the present invention. Thus, appearances of the phrases "in one embodiment," "in an embodiment," "in a preferred embodiment," and similar language throughout this specification may, but do not necessarily, all refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

While the present invention has been described in connection with certain exemplary or specific embodiments, it is to be understood that the invention is not limited to the disclosed embodiments, but, on the contrary, is intended to cover various modifications, alternatives, modifications and equivalent arrangements as will be apparent to those skilled in the art. Any such changes, modifications, alternatives, modifications, equivalents and the like may be made without departing from the spirit and scope of the invention.

The invention claimed is:

1. In combination, safety mat for a parapet cap on a wall, the wall having a top and two sides to which the parapet cap is attached, the parapet cap having a first side and a second side extending over the top of the wall and partially down each side of the wall, and including a flexible pad having a width greater than a width of the top of the wall, a first cinch down strap extending at a first end thereof from an interior of the pad toward a first width end attached to the first side of the parapet cap, and a second cinch down strap extending at a first end thereof from the interior of the pad toward a second width end attached to the second side of the parapet cap.

2. The combination of claim 1 wherein the first and second cinch down straps include hooks on an end opposite the interior of the pad.

3. The combination of claim 1 further comprising a third cinch down strap extending at a first end thereof from the interior of the pad toward a first width end; and a fourth cinch down strap extending at a first end thereof from the interior of the pad toward a second width end.

4. The combination of claim 3 wherein the cinch down straps include hooks on an end opposite the interior of the pad.

5. The combination of claim 4 wherein the width is dimensioned so that the flexible pad hangs over the parapet cap extending partially down the wall when the safety mat is in a deployed position.

6. The combination of claim 5 further comprising a pair of ladder cinch down straps extending at a first end thereof from the interior of the pad.

7. The combination of claim 6 further comprising a pair of ladder mounting straps for holding the safety mat onto a ladder while the ladder is lifted.

8. The combination of claim 3 including a fifth cinch down strap between the first end and the second end of the safety mat extending from the interior thereof toward the second width end.

9. The combination of claim 8 wherein the flexible pad further includes a length and an open pattern section extending the entire length of the pad and a part of the width of the pad.

10. The combination of claim 9 wherein the width of the open pattern section is at least as wide as the section of the parapet cap covering the top of the wall.

11. The combination of claim 8 including a retainer for holding the safety mat in a compact state when not deployed.

12. A method of protecting a parapet cap disposed over the top of a wall and extending at least partially down each side of the wall, the method comprising:

providing a safety mat including a flexible pad having a width greater than a width of the top wall; a first cinch down strap extending at a first end thereof from an interior of the pad toward a first width end; and a second cinch down strap extending at a first end thereof from the interior of the pad toward a second width end;

placing the safety mat over the top of the wall so that first and second cinch down straps hang over different sides of the parapet cap; and securing each of the first and second cinch down straps to a respective end of the parapet cap extending down the wall.

13. The method of claim 12 wherein the safety mat further includes a third cinch down strap extending at a first end thereof from the interior of the pad toward a first width end; and a fourth cinch down strap extending at a first end thereof from the interior of the pad toward a second width end, the method further comprising the step of securing each of the third and fourth cinch down strap to a respective end of the parapet cap extending down the wall.

14. The method of claim 13 wherein the safety mat further includes a fifth cinch down strap between the first end and the second end of the safety mat extending from the interior thereof toward the second width end, the method further comprising the step of securing the fifth cinch down strap to a respective end of the parapet cap extending down the wall.

15. The method of claim 14 wherein each of the cinch down straps include hooks on an end opposite the interior of the pad.

16. The method of claim 15 wherein the width of the flexible pad is dimensioned so that the flexible pad hangs over the parapet cap extending partially down the wall when the safety mat is in the deployed position.

17. The method of claim 16 wherein the flexible pad further includes a length and an open pattern section extending the entire length of the pad and a part of the width of the pad.

18. The method of claim 17 wherein the width of the open pattern section is at least as wide as the section of the parapet cap covering the top of the wall.

19. The method of claim 16 wherein the safety mat further includes a pair of ladder mounting straps for holding the safety mat onto a top of a ladder while the ladder is lifted.

20. The method of claim 15 wherein the safety mat further includes a pair of ladder cinch down straps extending at a first end thereof from the interior of the pad, the method further comprising the step of placing a ladder against the safety mat and securing the ladder cinch straps to the ladder.

21. The method of claim 14 including a retainer for holding the safety mat in a compact state when not deployed.

* * * * *